United States Patent [19]

de Jong et al.

[11] Patent Number: 4,755,149

[45] Date of Patent: Jul. 5, 1988

[54] BLIND MATING CONNECTOR

[75] Inventors: Peter C. de Jong, Harrisburg; Clifford W. Lindgren, Middletown; Thomas J. Zola, Harrisburg, all of Pa.

[73] Assignee: AMP Incorporated, Harrisburg, Pa.

[21] Appl. No.: 897,186

[22] Filed: Aug. 15, 1986

[51] Int. Cl.[4] ..... H01R 13/64; H01R 23/70

[52] U.S. Cl. ..... 439/248; 439/629; 439/655

[58] Field of Search ..... 339/17 LC, 64 R, 64 M, 339/65, 66 R, 66 M, 128, 176 M, 186 R, 186 M, 195 M, 196 M, 126 R; 439/62, 544–547, 549, 557, 629, 660, 682, 692, 247–249, 655

[56] References Cited

U.S. PATENT DOCUMENTS

| | | | |
|---|---|---|---|
| 2,891,103 | 6/1959 | Swengel | 339/128 |
| 3,960,434 | 6/1976 | Soes | 339/176 M |
| 4,077,693 | 3/1978 | Briel, Jr. et al. | 339/128 |
| 4,221,458 | 9/1980 | Hughes et al. | 339/126 R |
| 4,235,502 | 11/1980 | Marks et al. | 339/128 |
| 4,376,565 | 3/1983 | Bird et al. | 339/186 M |
| 4,568,136 | 2/1986 | Reuss | 339/176 M |
| 4,580,868 | 4/1986 | Verstijnen | 339/186 M |

FOREIGN PATENT DOCUMENTS

| | | | |
|---|---|---|---|
| 2732519 | 2/1979 | Fed. Rep. of Germany | 339/65 |

*Primary Examiner*—Gil Weidenfeld
*Assistant Examiner*—Gary F. Paumen
*Attorney, Agent, or Firm*—David L. Smith

[57] ABSTRACT

A receptacle and mating header that can be blindly mated from an initially misaligned condition. The header is rigidly mounted while the receptacle is mounted such that the receptacle can move vertically or laterally in a plane transverse to the axial alignment of pins or sockets therein. The receptacle and mating header have complimentary guide means and lead-in surfaces that engage as mating is attempted and urge the header and receptacle to align for mating.

11 Claims, 10 Drawing Sheets

BLIND MATING CONNECTOR

BACKGROUND OF THE INVENTION

This invention relates to electrical connectors of the type comprising a receptacle and mating header and in particular to a receptacle which, when mounted such as in a printed circuit board, floats in a plane transverse to axial alignment of pins or sockets therein so that the receptacle and mating header can be blindly mated from an initially misaligned position.

Electrical connectors are frequenty used in subassemblies to interconnect circuits or components on one subassembly with circuits or components on another subassemby. The interconnection whether board to board, board to cable, etc. is often completed by a human during assembly of the final product from subassemblies. The human in the assembly process provides feedback to assure that when an electrical connector is employed, the header is aligned and mated with the receptacle.

Where electronic circuitry is drawer-mounted for removal for service or testing, the drawer-mounted circuitry is typically connected to a receptacle or header on the drawer that must mate upon insertion of the drawer with a mating header or receptacle. Although the drawer is guided by track mounting hardware generally aligning the receptacle and header for mating, the connector receptacie and header must provide for alignment of the pins and sockets therein. Posts having conical tips extending beyond the mating face of the receptacle that engage the interior of cylindrical post in the header have been used.

SUMMARY OF THE INVENTION

The present invention provides a receptacle for mounting in a first subassembly capable of moving vertically and laterally a predetermined limited distance in a plane transverse to electrical contacts therein so as to blindly mate with a header mounted in a second subassembly as the two subassemblies are assembled, such as in a drawer-mount. The receptacle has mounting means, extending normal to the axis of electrical contacts therein, that are longer than minimally necessary to mount the receptacle on a support and further the mounting means engage the support through an aperture that is larger in a direction normal to the electrical contacts than is minimally necessary for passage of the mounting means therethrough. Vertical and lateral guide means on the receptacle, both functions which may be provided by a single guide member, originate on the forward mating face of the receptacle, taper rearward and cooperate with complimentary channels on the header to urge the receptacle and header to align as they engage prior to mating. The header has a U-shaped cross section the interior of which forms a cavity to receive the receptacle. The header is comprised of a plurality of adjacent U-shaped members having therebetween a post seating channel and limited solid regions to join and support adjacent members. Posts extend into the cavity to engage contacts in the receptacle, when mated. The ends of the legs taper inward to walls formed by the legs, providing funnel-like lead-in surfaces that, upon engagement with the receptacle, aid in vertical alignment. The ends of the legs may also taper inward to the channel, normal to the walls, to provide lead in surfaces for lateral guide means.

DESCRIPTION OF THE PREFERRED EMBODIMENT

Figure 1:
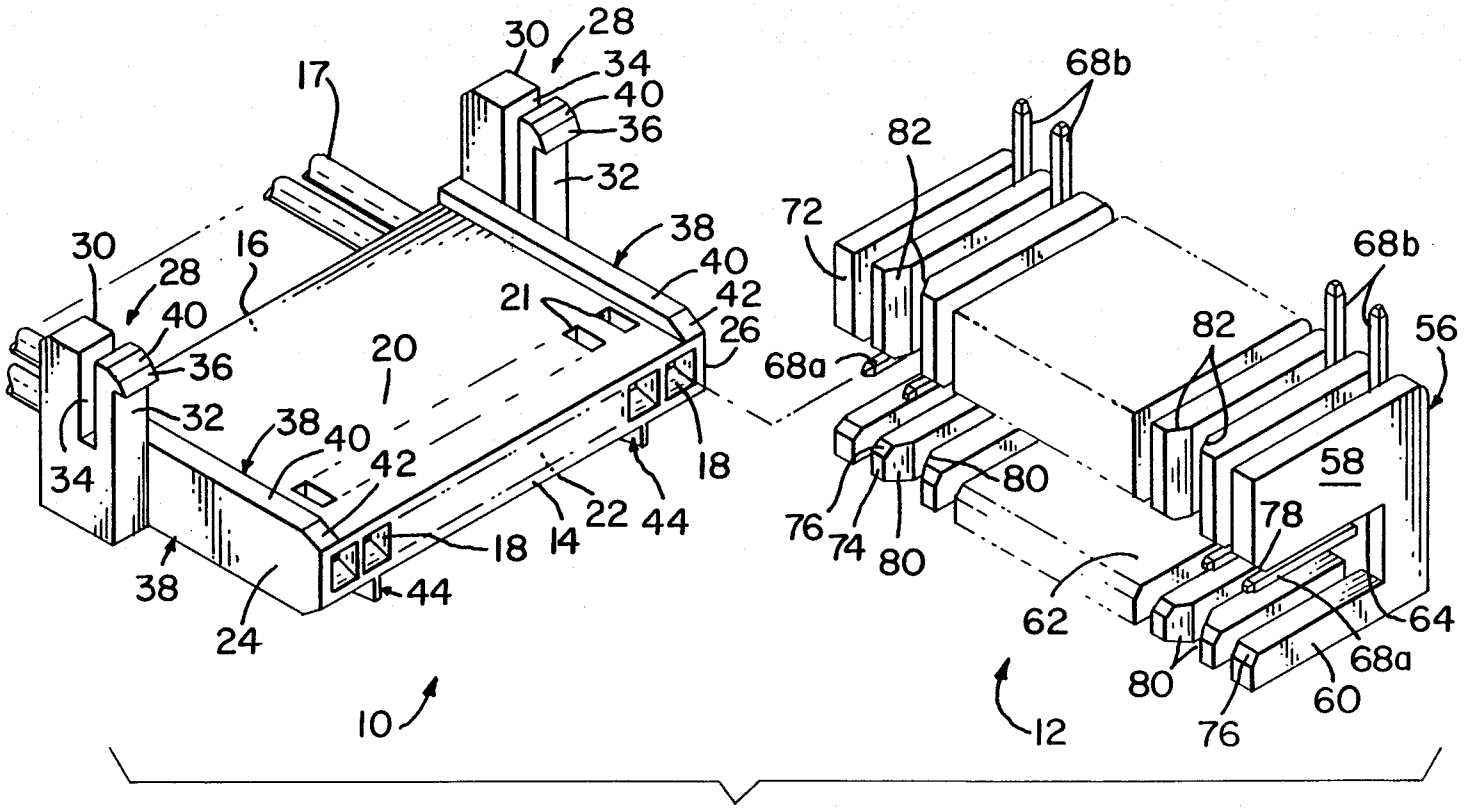
FIG. 1 is a perspective view of a floating mount receptacle and mating header in accordance with the present invention.

Referring to the drawings, initially to FIG. 1, there is depicted therein a receptacle 10 and header 12 in accordance with the present invention. Receptacle 10 includes a housing 11 which is molded of a suitable dielectric material and has forward mating face 14, an opposed conductor receiving rear face 16, contact receiving passages 18 extending therebetween, an upper surface 20, a lower surface 22, and opposed endwalls 24 and 26.

Electrical contacts 15 terminated to insulated electrical conductors 17 are secured in passages 18 of housing 11 for electrical engagement with posts 68 within header 12. Lances 19 on contacts 15 are disposed in openings 21 of housing 11 to prevent withdrawal of contacts 15 and contacts 15 abut shoulders 23 in passages 18 limiting their inner movement therein. Passages 18 have tapered surfaces 25 at face 14 to facilitate insertion of posts 68 therein for electrical engagement with contacts 15 when receptacle 10 and header 12 are mated.

Receptacle 10 has a mounting means 28 extending upward from upper surface 20 at the rear of each endwall 24 and 26 so as not interfere with mating. Each upwardy extending mounting means 28 is comprised of a rigid rear member 30 of rectangular cross section and a flexible forward member 32 also of rectangular cross section with a gap 34 therebetween. Flexible member 32 terminates in a latch 36 extending forward beyond the rectangular cross section of flexible member 32. Latch 36 may have a top surface including a compound angle for easy insertion. The depth of gap 34 is sufficient for flexible member 32 to bend and allow latch 36 to enter and clear a mounting hole.

Receptacle 10 is typically mounted such that mounting means 28 pass through a pair of spaced rectangular holes 35, 37 in a printed circuit board 39. The width in one direction of the spaced rectangular holes 35, 37 is substantially the combined depth of rigid rear member 30, gap 34 and flexible forward member 32 such that rigid member 30 engages surface 94 of printed circuit board 39 and flexble member 32 engages surface 96 of printed circuit board 39. With receptacle 10 thus mounted. contacts 15 retain substantially parallel to printed circuit board 39 regardless of the position of mounting means 28 in holes 35 and 37. Receptacle 10 may be mounted such that there is some compression on flexible member 32. The width in a second direction of the spaced rectanguar holes 35, 37 for mounting receptacle 10 is greater than the width of mounting means 28 to permit mounting means 28 and hence receptacle 10 to move laterally.

Receptacle 10 has on upper surface 20 and lower surface 22 guide means originating on the forward mating face 14 of receptacle 10 and extending rearward therefrom for vertically aligning receptacle 10 with header 12. In the preferred embodiment, the guide means are ribs 38 of rectangular cross section originating on the forward mating face 14 of receptacle 10 and extending rearward to rear face 16. Ribs 38 are tapered rearward from forward mating face 14 to surface 40 thereby providing a tapered lead-in surface 42 which upon engaging header 12 urges receptacle 10 and header 12 to align for mating. Surface 40 of ribs 38 on the upper surface 20 and lower surface 22 are parallel for establishing as well as maintaining the vertical positioning of receptacle 10 in header 12 as there is clearance between upper surface 20 and wall 64 as well as between lower surface 22 and wall 62. Parallel surfaces 40 are spaced substantially the same distance apart as walls 62 and 64 defining cavity 66 such that surfaces 40 slidingly engage walls 62 and 64 during mating. Ribs 38 are sufficiently wide to span a post seating channel 70 thereby, depending upon position, engaging two members 56.

In the preferred embodiment, ribs 38 are located on upper surface 20 and lower surface 22 near endwalls 24 and 26 to provide the longest possible moment arm to assist aligning receptacle 10 with header 12. However, the invention is not limited thereto. The vertical alignment guide means, for example, could be mounted laterally from end walls 24 and 26.

Figure 3:
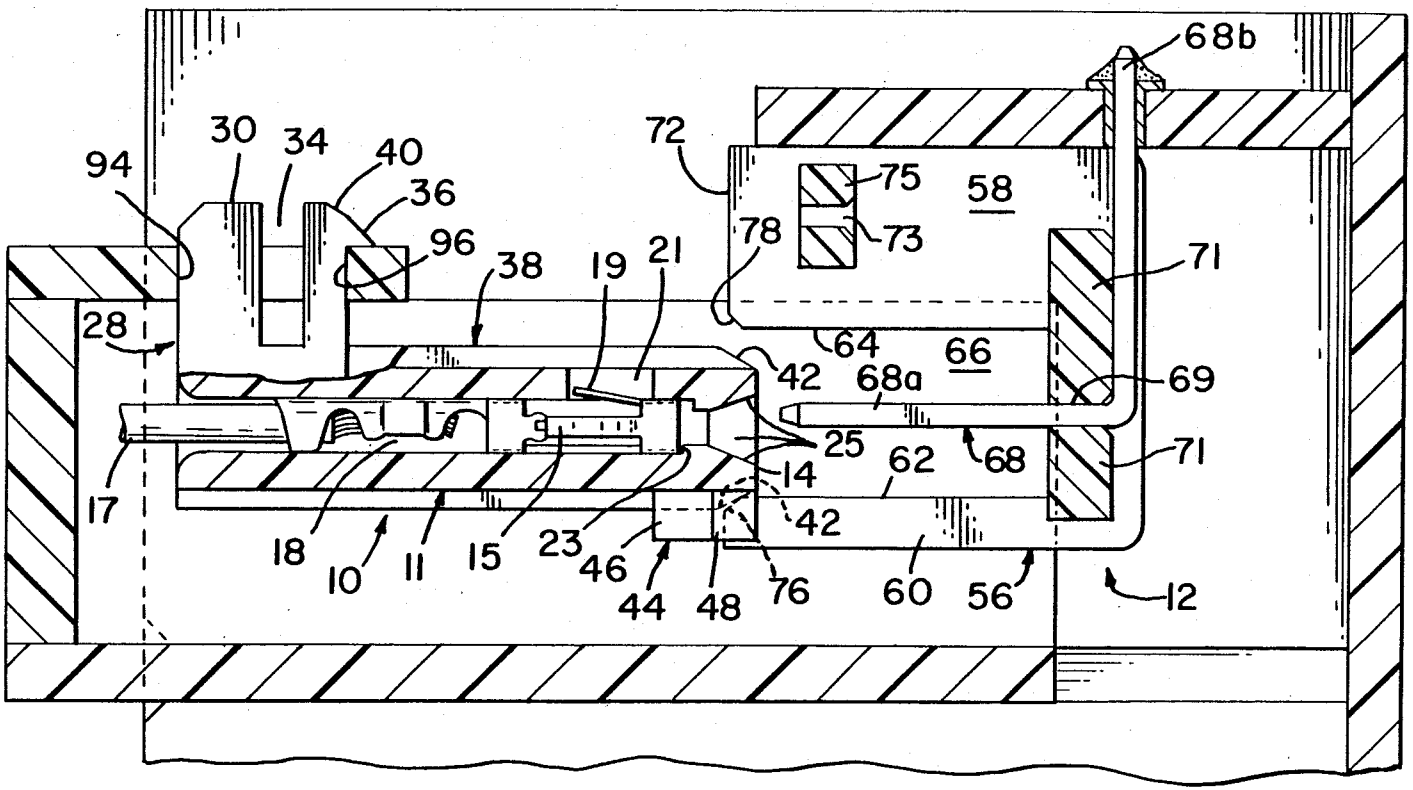
FIG. 3 is an enlarged cross section showing the drawer-mount system with the floating-mount receptacle and mating header engaged but misaligned for blind mating.
Figure 4:
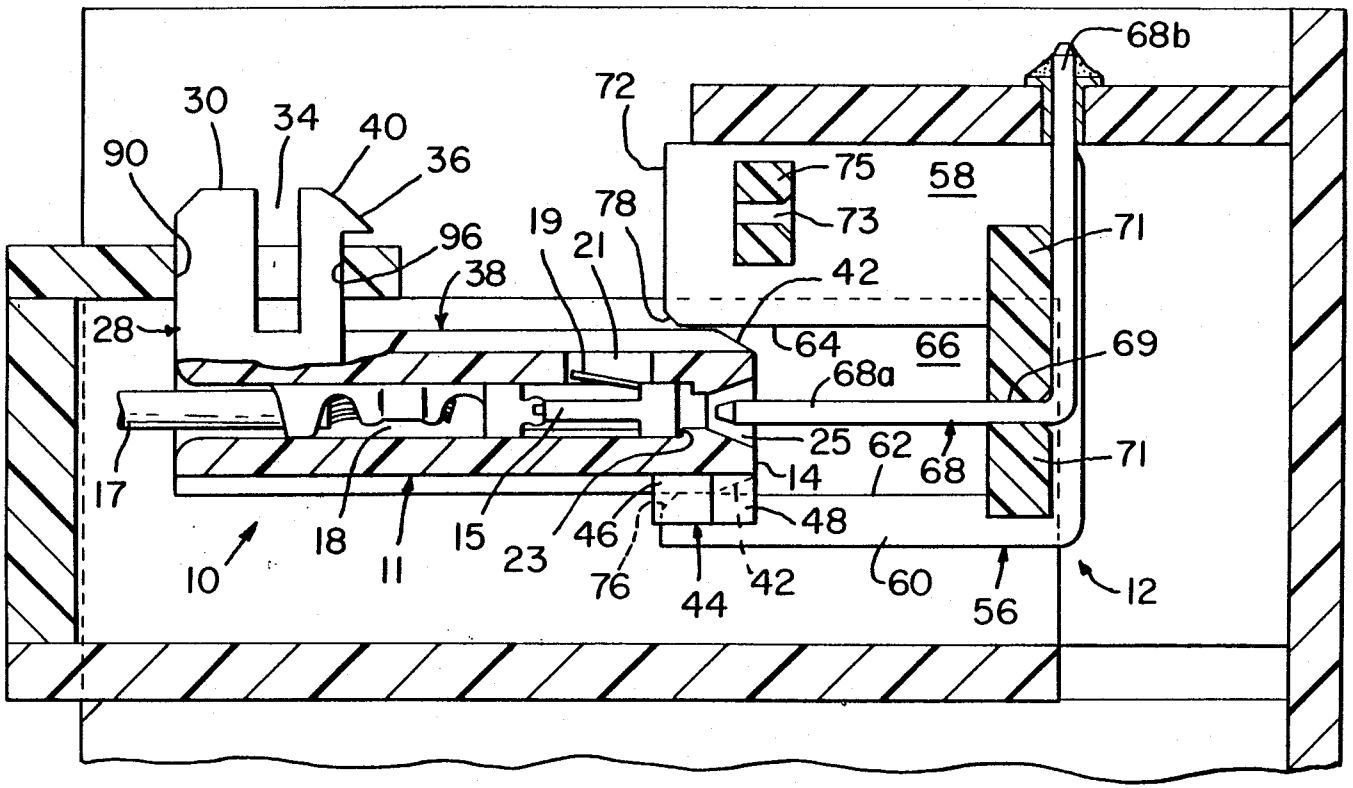
FIG. 4 is an enlarged cross-section showing the floating mount receptacle and mating header aligned for blind mating.
Figure 5:
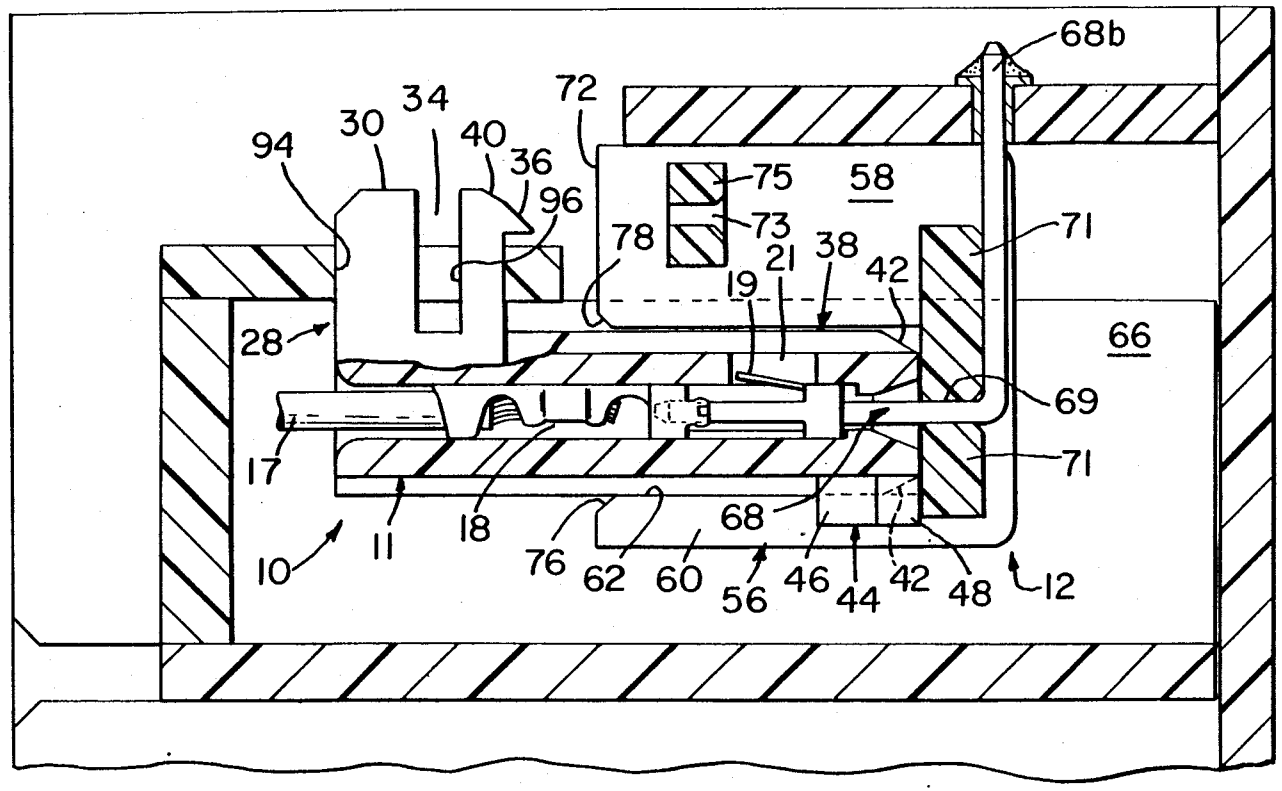
FIG. 5 is an enlarged cross-section showing the floating mount receptacle and mating header aligned and fully mated.

FIGS. 3, 4 and 5 show a side-view sequence of receptacle 10 and header 12 engaging, vertcally aligning and mating. FIG. 3 shows mounting means 28 maintaining contact 15 parallel to the receptacle mating portion 68*a* of post 68 as receptacle 10 and header 12 engage. Contact 15 remains parallel to mating portion 68*a* due to the above described fit of mounting means 28 in holes 35 and 37. As receptacle 10 and header 12 engage during blind mating, more specifically as lead-in surface 42 on receptacle 10 engages lead-in surface 76 or lead-in surface 78 on header 12, a vectorial force is transmitted through housing 11. The lateral component of the vectorial force, as viewed in FIG. 3, does not move mounting means 28 within holes 35 and 37 due to the rigidity of rigid member 30. In the plane of the figures, the vertical component of the vectorial force, also transmitted through housing 11, causes mounting means 28 to slide along surfaces 94 and 96 in holes 35 and 37 while maintaining, contacts 15 substantially parallel to mating portion 68*a* of posts 68 as lead-in surface 42 on receptacle 10 slidingly engages lead-in surface 76 or 78 on header 12. When the chamfered end of mating portion 68*a* is within tapered surfaces 25 of passages 18, engagement therebetween also assists in alignment.

FIG. 4 shows receptacle 10 and header 12 at a subsequent point in the blind mating process with contacts 15 axially aligned with mating portion 68*a* of posts 68. Housing 11 is partially within cavity 66.

FIG. 5 shows receptacle 10 mated with header 12 with mating face 14 bottomed in cavity 66. When mated, about half of receptacle 10 is disposed within header 12 providing good support therebetween as well as additional insulaton for contacts 15 and posts 68.

Figure 10:
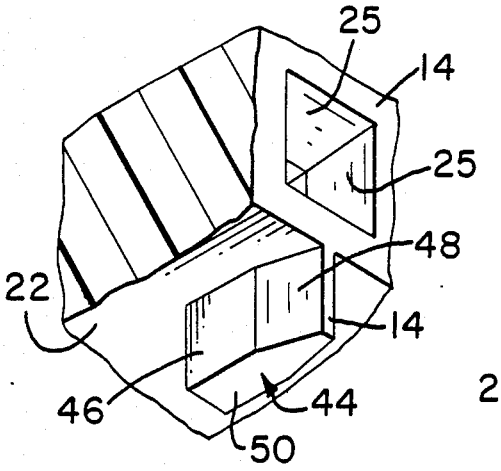
FIG. 10 is a perspective view of a lateral alignment guide.

Receptacle 10 also has guide means for laterally aligning receptacle 10 with header 12. In the preferred embodiment, the lateral guide means are projections 44 extending downward from lower surface 22 as shown in FIG. 1 and better seen in FIG. 10. Projections 44 orginate on the forward mating face 14 of receptacle 10 and extend rearward. Projections 44 taper laterally to sides 46 forming tapered lead-in surfaces 48 which upon engaging header 12 urges receptacle 10 to move laterally relative to header 12 to align for mating. The depth of projections 44 from lower surface 22 to surface 50 is typically greater than the depth of ribs 38 as projections 44 are received in respective channels in header 12. The width of projections 44 are of a width to be received in the corresponding channels in header 12.

Figure 11:
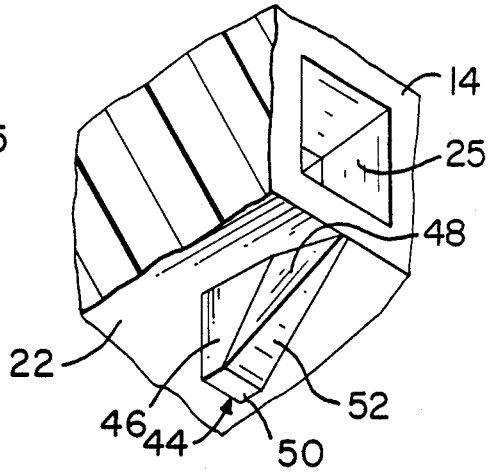
FIG. 11 is a perspective view of an alternate embodiment of a lateral alignment guide having a compound angle surface.

Projections 44 may have a further taper from forward mating face 14 to surface 50 resulting in an alternate embodiment as shown in FIG. 11. The compound angle thus achieved provides surface 52, typically at the safe angle with respect to lower surface 22 as taper lead-in surfaces 42 on ribs 38, to assist in vertical alignment of receptacle 10 with header 12 as well as to laterally align receptacle 10 with header 12.

Although lateral guide means are shown on the lower surface 22 of receptacle 10, the invention is not limited thereto. The lateral guide means could, for example, be mounted from upper surface 20 or from opposed endwalls 24 and 26.

Figure 6:
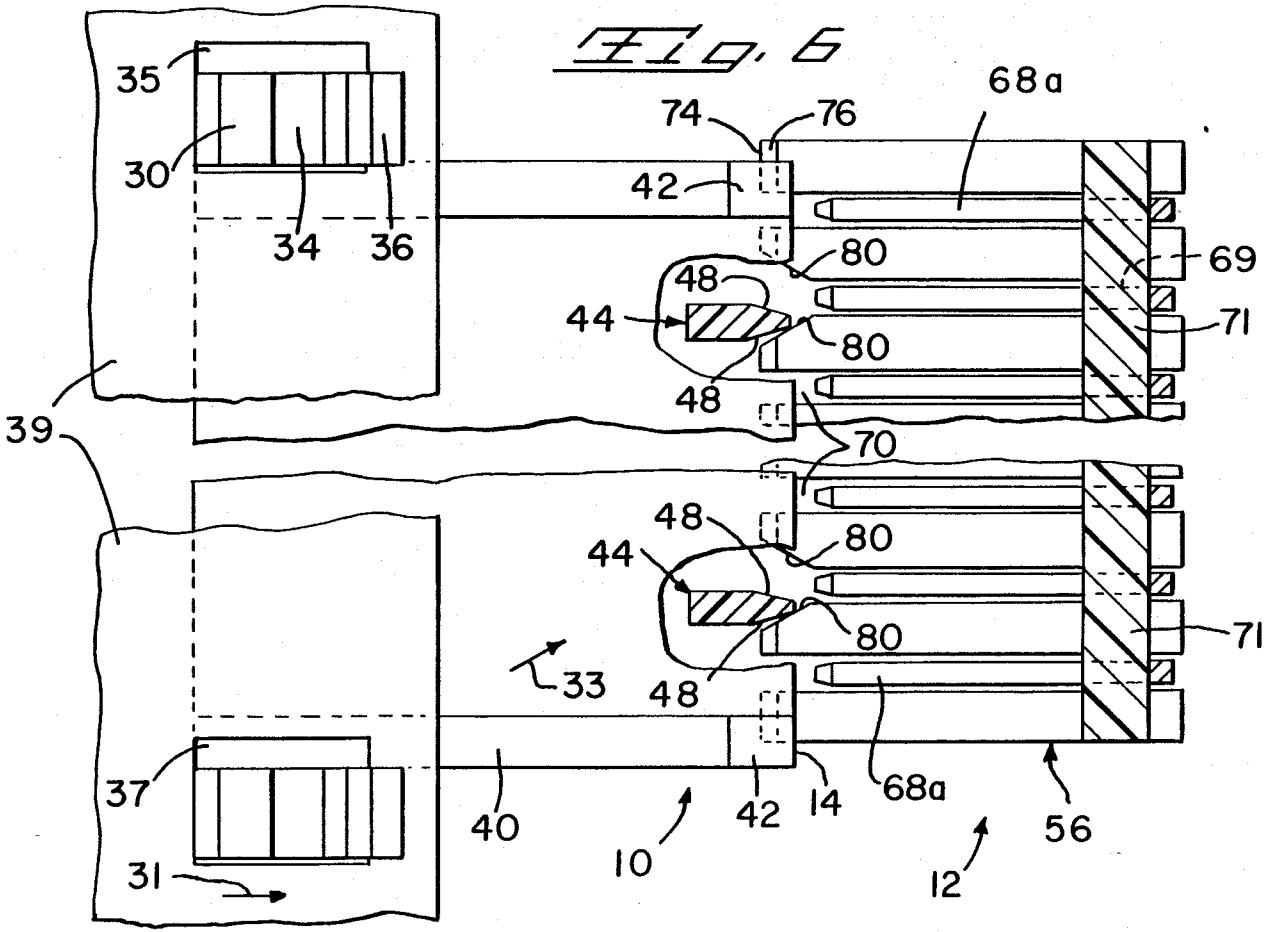
FIG. 6 is a top view, partly in section, showing the floating mount receptacle and mating header engaged but misaligned for blind mating.
Figure 7:
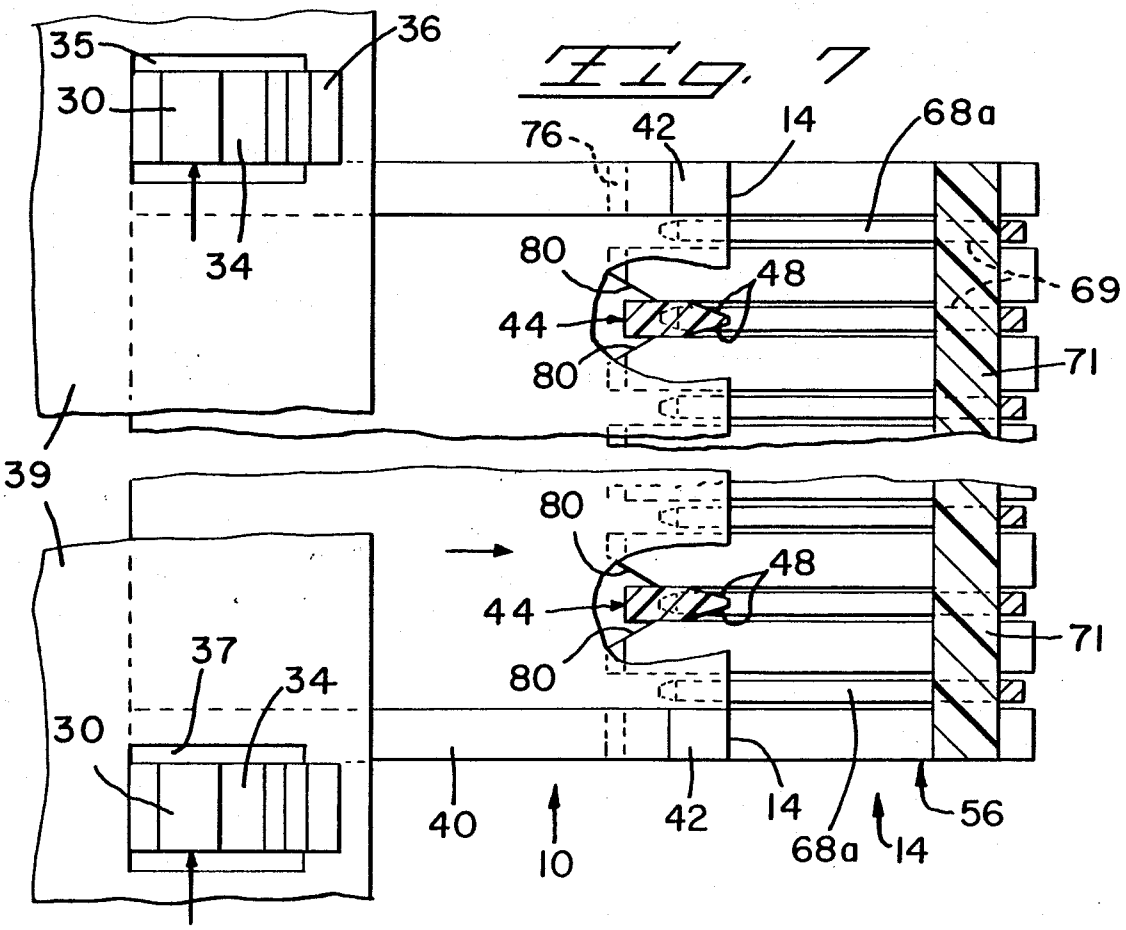
FIG. 7 is an enlarged cross-section showing the floating mount receptacle and mating header aligned in the blind mating process.

FIGS. 6 and 7 show a top view sequence of receptacle 10 and header 12 engaging, laterally aligning and mating. FIG. 6 shows lateral guide means, projections 44, on receptacle 10 engaging lead-in surface 80 on header 12 during blind mating. As printed circuit board 39 supporting receptacle 10 is a advanced toward header 10 in the direction of arrow 31 and receptacle 10 engages header 12, a vectorial force is transmitted through housing 11 which causes receptacle 10 to move diagonally in the direction of arrow 33. The lateral component of the vectorial force causes mounting means 28 to slide along surfaces 94 and 96 in holes 35 and 37 while maintaining contacts 15 substantially parallel to mating portion 68*a* of posts 68 as projections 44 slidingly engage lead-in surfaces 80.

FIG. 7 shows receptacle 10 laterally aligned with header 12 at a subsequent point in the blind mating process.

Figure 8:
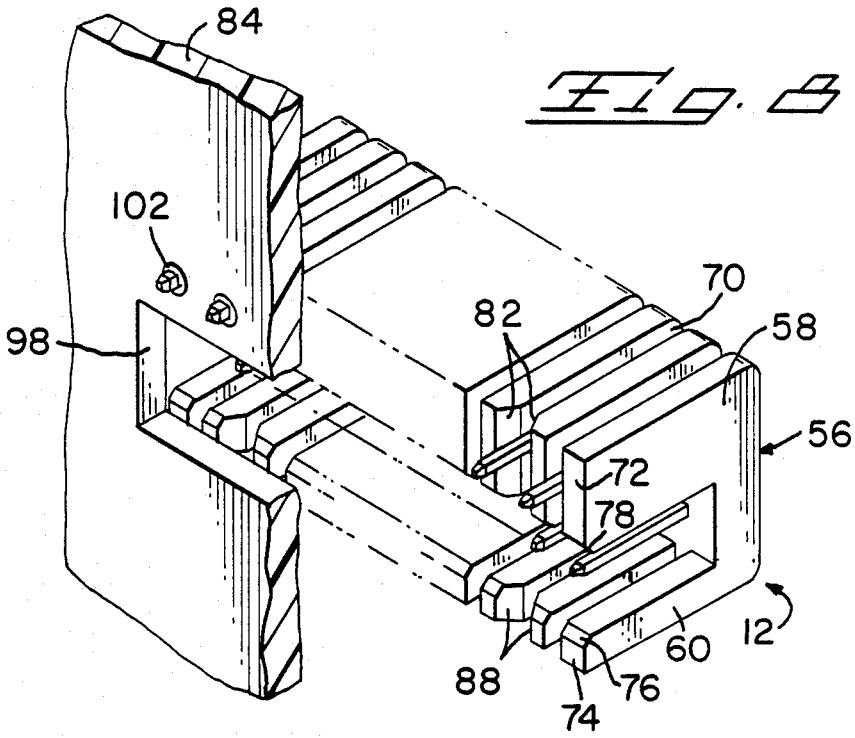
FIG. 8 is a perspective view of a header showing a through-board mount.
Figure 9:
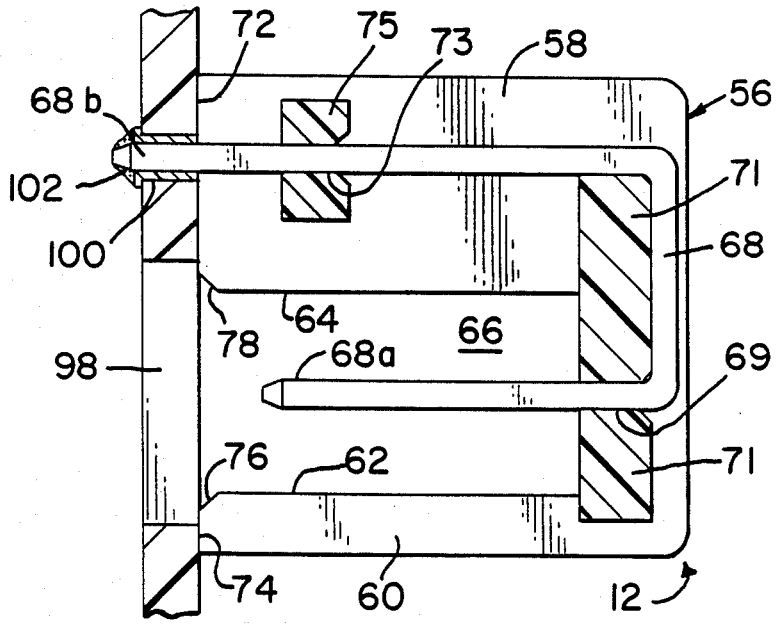
FIG. 9 is a cross section of the header of FIG. 8.

Header 12 is also molded of a suitable dielectric material. Header 12 is comprised of a plurality of U-shaped members 56 with limited areas of solid material extending therethrough and separated by parallel post seating channels 70 of rectangular cross section as best seen in FIGS. 8 and 9. U-shaped members 56 aid in maintaining the position of posts 68 and provide insulation therebetween. Header 12 is generally of a U-shape cross-section having two legs 58 and 60 of typically equal length but possibly of different cross sectional area forming a pair of spaced parallel walls 62 and 64 defining therebetween a cavity 66 for receiving receptacle 10. Header 12 is comprised of a plurality of adjacent U-shaped members 56 having therebetween a post seating channel 70 and limited U-shaped members connecting regions 71 and 75 of solid dielectric material. The connecting regions join and support adjacent U-shaped members making a plurality of U-shaped members 56 a single structure. Although legs 58 and 60 may have the same cross section, for through board mount applications providing leg 58 with a greater cross section than leg 60 permits the through holes 100 in the circuit board into which ends 68*b* of posts 68 are soldered at 102 to be a greater distance from cut-out 98 through which receptacle 12 passes and simultaneously minimizes the reactionary moment developed by the mating force during mating.

A plurality of posts 68 are frictionally disposed in header 12 having a first chamfered end 68*a* extending into cavity 66 parallel to walls 62 and 64. Walls 62 and 64 typically extend a short distance beyond posts 68 and thereby afford some protection to posts 68 during handling as well as during insertion and after insertion of header 12 in a printed circuit board. The number and location of posts 68 typically corresponds to the number and location of contact receiving passages 18 in receptace 10. Each post 68 passes through apertures 69 in connecting regions 71 of header 12 in an interference fit thence bends 90° into a post seating channel 70 along region 71 between adjacent U-shaped members 56. For parallel board mount applications, the second chamfered end 68*b* of post 68 extends beyond header 12 perpendicular to walls 62 and 64 as seen in FIG. 3. For through board mount applications, posts 68 contain a second 90° bend then extend through apertures 73 in connecting regions 75 to remain in post seating channel 70 with the second chamfered end 68*b* extending parallel to walls 62 and 64 beyond end 72 of leg 58 as best seen in FIG. 9. The interference fit of posts 68 in apertures 69 and 73 of regions 71 and 75 coupled with the second ends 68*b* of posts 68 soldered onto a printed circuit board hold header 12 as well as post 68 in position during mating of receptacle 10 and header 12.

The ends 72 and 74 of legs 58 and 60 respectively are tapered inward to walls 62 and 64 respectively defining lead-in surfaces 76 and 78 that may engage lead-in surfaces on receptacle 10 to urge vertical alignment of receptacle 10 and header 12 upon engaging. The post seating channel 70 extends, in the preferred embodiment, between adjacent U-shaped members 56 also forming channels in wall 62 and 44. These are the parallel channels that are complimentary guide means for projections 44 to slide into as receptacle 10 and header 12 are mated. Ends 72 and 74 of legs 58 and 60 respectively are tapered inward normal to walls 62 and 64 forming lead-in surfaces 80 and 82, at least in those channels where protections 44 will engage header 12.

Figure 13:
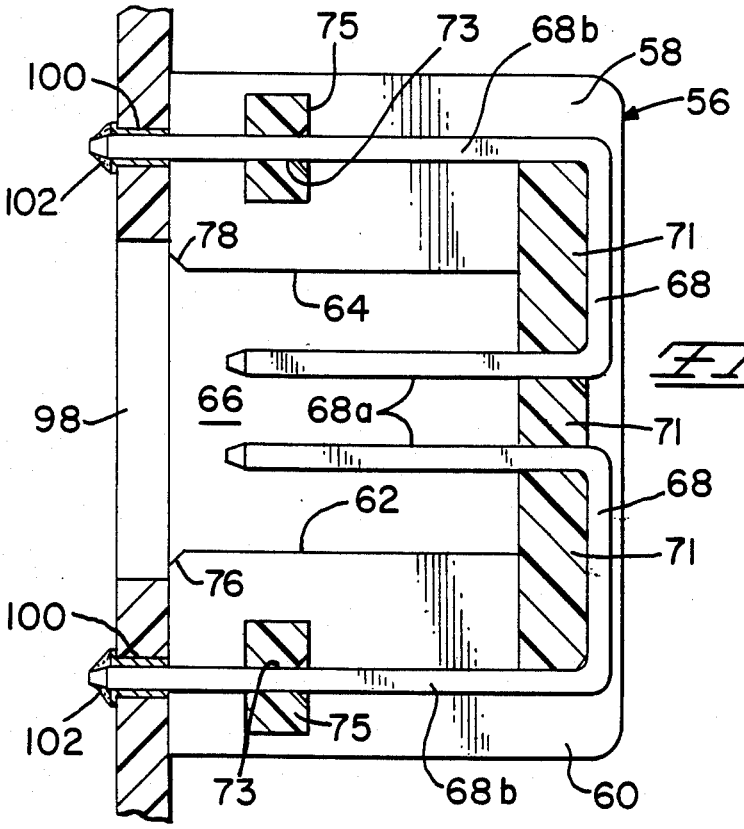
FIG. 13 is a cross-section of the two row header shown in FIG. 12.
Figure 12:
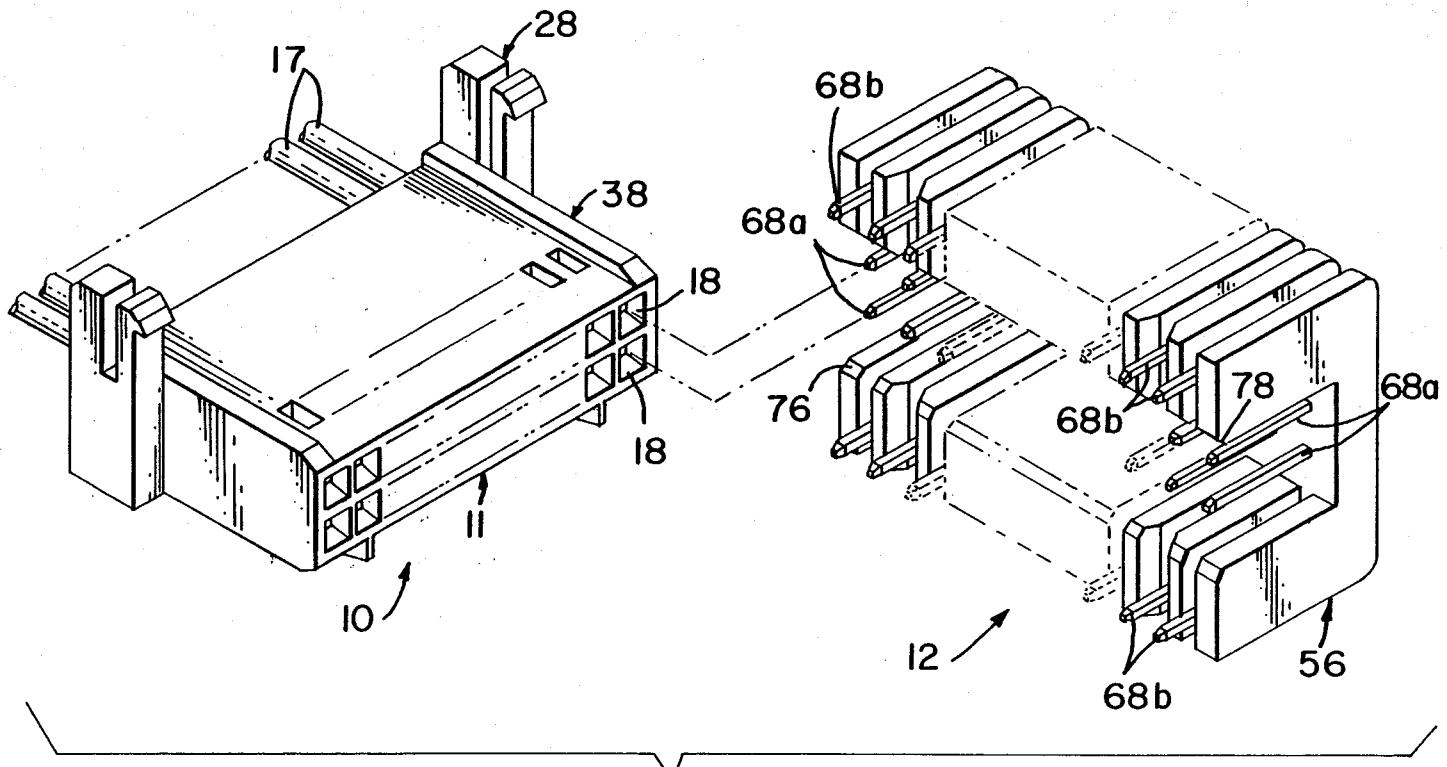
FIG. 12 is an alternate embodiment of a floating mount receptacle and header, each having two rows of electrical contacts.

FIG. 12 shows an alternate embodment of the invention wherein receptacle 10 has two rows of passages 18 and header 12 has correspondingly two rows of posts 68. The alternate embodiment of header 12, a cross section of which is shown in FIG. 13, is shown for through board mounting. In a preferred alternate embodiment, each row of posts 68 are frictionally disposed in apertures 69 in regon 71 in an interference fit thence bend 90°, with one row of posts bending in a first direction and the second row of posts bending in a second direction 180° from the first direction, into a post seating channel 70 along region 71 between adjacent U-shaped members 56. The second chamfered ends 68*b* contain a second 90° bend then extend through apertures 73 in connecting region 75 remaining in post seating channel 70 with ends 68*b* of posts 68 extending parallel to walls 62 and 64 beyond end 72 and 74 of legs 58 and 60.

An alternate embodiment for a right angle mount would have multiple rows of posts 68 frictionally disposed in apertures in an interference fit with a first end 68*a* extending into cavity 66 and second ends 68*b* having 90° bends thence extending beyond one of legs 58 or 60 perpendicular to walls 62 and 64.

As best seen in FIG. 3, the forward mating face 14 of receptacle 10 will pass beyond the plane formed by ends 72 and 74 of legs 58 and 60, respectively. of header 12 before receptacle 10 and header 12 engage and commence alignment for mating. The vertical movement of receptacle 10 is achieved by providing a greater length to the mounting means 28 beneath the lower surface of latch 36 than is minimally required to mount receptacle 10 on printed circuit board 39. The lateral movement of receptacle 10 relative to printed circuit board 39 is achieved by providing mounting holes 35 and 37 in printed circuit board 39 that are wider than the width required by the mounting means.

Figure 2:
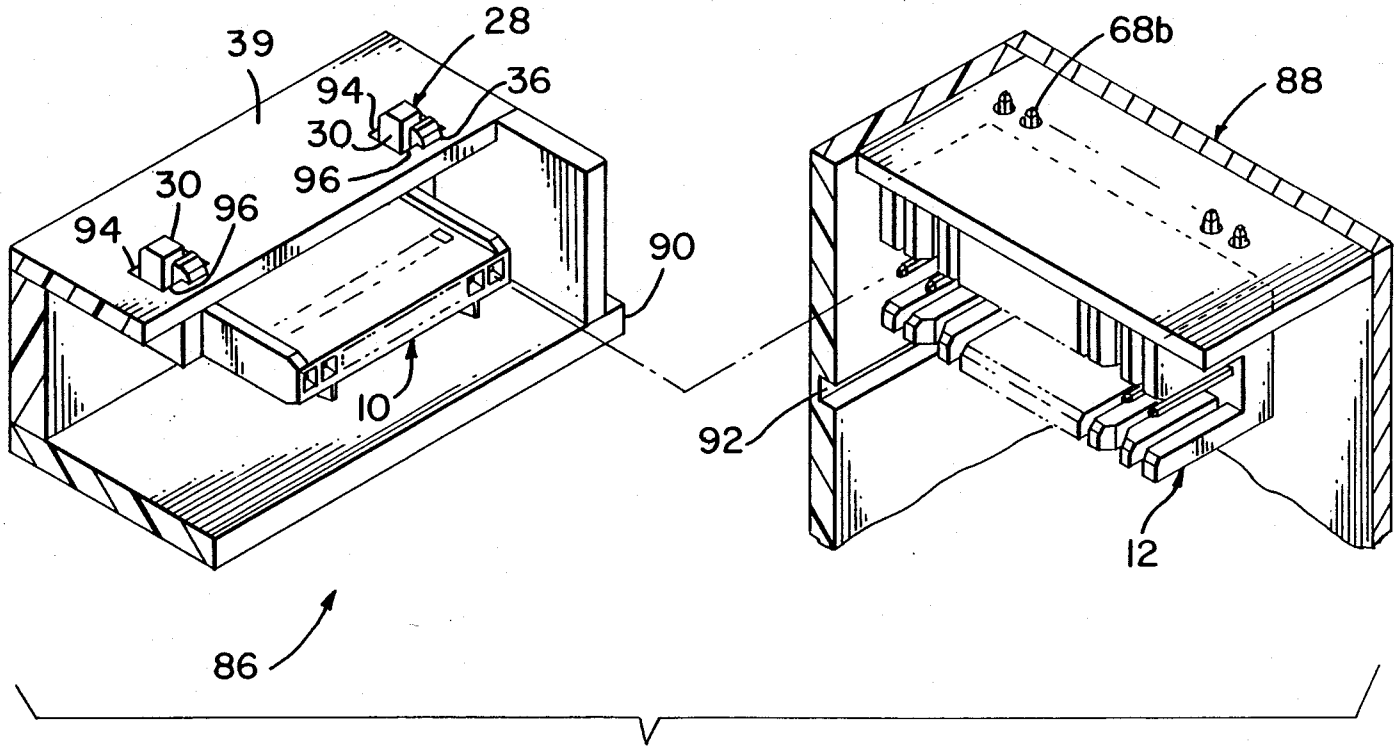
FIG. 2 is a perspective view of a floating mount receptacle and mating header showing a drawer-mount.

In a typical applicaton, shown in FIG. 2, header 12 is mounted on a printed circuit board 39 in a first subassembly 86. Receptacle 10 is part of a second subassemby 88 that is to be slide-mounted with the first subassembly by sliding extension 90 into channel 92.

In the typical mounting shown in FIG. 2, lateral movement of receptacle 10 is substantially parallel to printed circuit board 39 while vertical movement of receptacle 10 is substantially normal to printed circuit board 39. Although receptacle 10 and header 12 are shown mounted in a particular orientation and relative configuration, the invention is not limited thereto. For example, header 12 could be mounted from the lower side of a printed circuit board and still mate with a receptacle 10.

Receptacle 10 is not limited to being misaligned only vertically or only laterally with respect to header 12. Receptacle 10 may be skewed out of alignment both vertically and laterally within predetermined limits and a receptacle and header in accordance with the present invention will achieve alignment upon engaging.

We claim:

1. A blind mating electrical connector assembly, comprising:

a first electrical connector and a second electrical connector, said first electrical connector having a dielectric housing member including passages extending therethrough in which electrical contacts are secured, mounting means on said housing member for disposition in openings in a panel for mounting said first electrical connector thereon, the mounting means having sufficient length and dimensions so that said first electrical connector is movable vertically and laterally relative to the panel when said first and second electrical connectors are mated;

said second electrical connector having dielectric housing means including a cavity in which a front section of said first electrical connector is to be received, said housing means comprising a plurality of adjacent U-shaped members, the legs of which form a pair of spaced walls defining therebetween said cavity for receiving the front section of the first electrical connector, the ends of said legs being tapered inward to the walls providing lead-in surfaces to engage the first electrical connector, the adjacent U-shaped members having therebetween a terminal seating channel and limited connecting regions to join and support adjacent U-shaped members, said second electrical connector having electrical terminals frictionally disposed in apertures in said connecting regions, said terminals having a first end extending into the cavity parallel to the walls for electrical engagement with respective said contacts and a second end bending into said terminal seating channel thence extending beyond the second electrical connector for electrical connection to a circuit board; and guide means on said housing member and said housing means that are engageable when the connectors are mated so as to move the first electrical connector relative to the panel to properly align the connectors during their engagement.

2. An electrical connector assembly as recited in claim 1 wherein a leg of adjacent U-shaped members forming a post seating channel is tapered inward from the end thereof normal to the walls, thereby providing a lead-in surface.

3. An electrical connector assembly as recited in claim 1 wherein the legs of the U-shaped members are of equal length.

4. An electrical connector assembly as recited in claim 1 wherein the legs of a U-shaped member have different cross sectional areas.

5. An electrical connector assembly as recited in claim 1 wherein the second end of the terminals extend beyond the second electrical connector normal to the first end of the terminals.

6. An electrical connector assembly as recited in claim 1 wherein the second end of the terminals contain a second bend, remain in a terminal seating channel and extend beyond the second electrical connector parallel to the first end of the terminals.

7. In electrical connector assembly as recited in claim 1 wherein the terminals are configured in two rows with the second end of the first row of terminals bending in a first direction and the second end of the second row of terminals bending in a second direction, said second direction being lineraly opposed to said first direction.

8. A header connector for mounting to a printed circuit board for use in conjunction with a floating mount receptacle connector, comprising:

a plurality of adjacent U-shaped members, the legs of which form a pair of spaced walls defining therebetween a cavity for receiving a front section of the receptacle connector, the ends of said legs being tapered inward to the walls providing lead-in surfaces to engage the receptacle connector, the adjacent U-shaped members having therebetween a post seating channel and limited connecting regions to join and support adjacent U-shaped members, said header connector having a plurality of posts frictionally disposed in apertures in said connecting regions, said posts having a first end extending into the cavity parallel to the walls and a second end bending normal to said first end into a post seating channel thence extending beyond the header connector, wherein said second end of the posts contain a second bend, remain in a post seating channel and extend beyond the header connector parallel to the first end of the post.

9. A header connector as recited in claim 8 wherein the posts are configured in two rows with the second end of the first row of posts bending in a first direction and the second end of the second row of posts bending in a second direction, said second direction being linearly opposed to said first direction.

10. A header connector for mounting to a printed circuit board for use in conjunction with a floating mount receptacle connector, comprising:

a plurality of adjacent U-shaped members, the legs of which form a pair of spaced walls defining therebetween a cavity for receiving a front section of the receptacle connector, lead-in means provided by tapered surfaces on the header connector for engaging the receptacle connector and for aligning the receptacle and header connectors during mating, the adjacent U-shaped members having therebetween a post seating channel and limited connecting regions to join and support adjacent U-shaped members, said header connector having a plurality of posts frictionally disposed in apertures in said connecting regions, said posts having a first end extending into the cavity parallel to the walls and a second end bending normal to said first end into a post seating channel thence extending beyond the header connector, wherein said second end of the posts contain a sceond bend, remain in a post seating channel and extend beyond the header connector parallel to the first end of the post.

11. A header connector as recited in claim 10 wherein the posts are configured in two rows with the second end of the first row of posts bending in a first direction and the second end of the second row of posts bending in a second direction, said second direction being linearly opposed to said first direction.

* * * * *